United States Patent [19]

Tinchant

[11] 4,342,118

[45] Jul. 27, 1982

[54] PANEL FOR ELECTRIC FURNACE

[75] Inventor: Xavier Tinchant, Villars, France

[73] Assignee: Clesid S.A., Saint-Chamond, France

[21] Appl. No.: 219,309

[22] PCT Filed: Jan. 4, 1980

[86] PCT No.: PCT/FR80/00003

§ 371 Date: Sep. 2, 1980

§ 102(e) Date: Sep. 2, 1980

[30] Foreign Application Priority Data

Jan. 4, 1979 [FR] France ..... 79 00131

[51] Int. Cl.[3] ..... F27D 1/12

[52] U.S. Cl. ..... 373/76; 432/238

[58] Field of Search ..... 13/32, 35; 432/238, 432/237; 266/280

[56] References Cited

U.S. PATENT DOCUMENTS

| | | | |
|---|---|---|---|
| 4,000,595 | 1/1977 | Fortescue | 13/32 X |
| 4,206,312 | 6/1980 | Kuhlmann | 13/32 |
| 4,221,922 | 9/1980 | Okimune | 13/32 |
| 4,241,232 | 12/1980 | Gelsing | 13/32 |

*Primary Examiner*—Roy N. Envall, Jr.

[57] ABSTRACT

A panel cooled by the circulation of water and adapted to constitute all or part of a wall of an electric arc furnace. The panel consists, at the inside of the furnace, of a thick and corrugated wall to which is welded, at the outside of the furnace, a second thinner wall, the two walls defining passages adapted for the circulation of the water. The invention is used in electric arc furnaces for steel mills.

5 Claims, 2 Drawing Figures

PANEL FOR ELECTRIC FURNACE

The present invention relates to a panel cooled by the circulation of liquid, adapted to constitute all or part of a wall of an electric arc furnace.

There is a tendency at present to replace at least certain walls of electric furnaces by metallic panels cooled by the circulation of water. In order to prevent such a wall from deteriorating rapidly, on the striking of an arc or in the event of a shock with scrap iron contained in the furance, it is essential to have a great thickness at the inside of the furnace.

The invention relates to a panel of this type, made in an effective, simple and inexpensive manner. It is characterized in that it consists, at the inside of the furnace, of a thick corrugated wall to which there is welded, at the outside of the furnace, a second thinner wall, defining with the first, passages adapted for the circulation of the cooling liquid.

Figure 1:
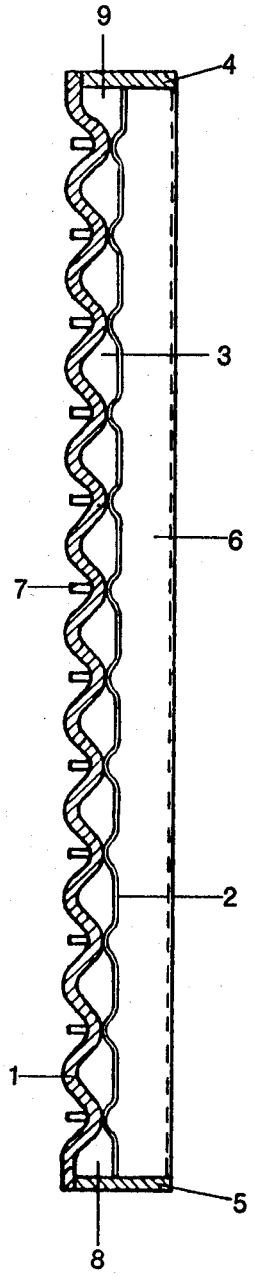
Figure 2:
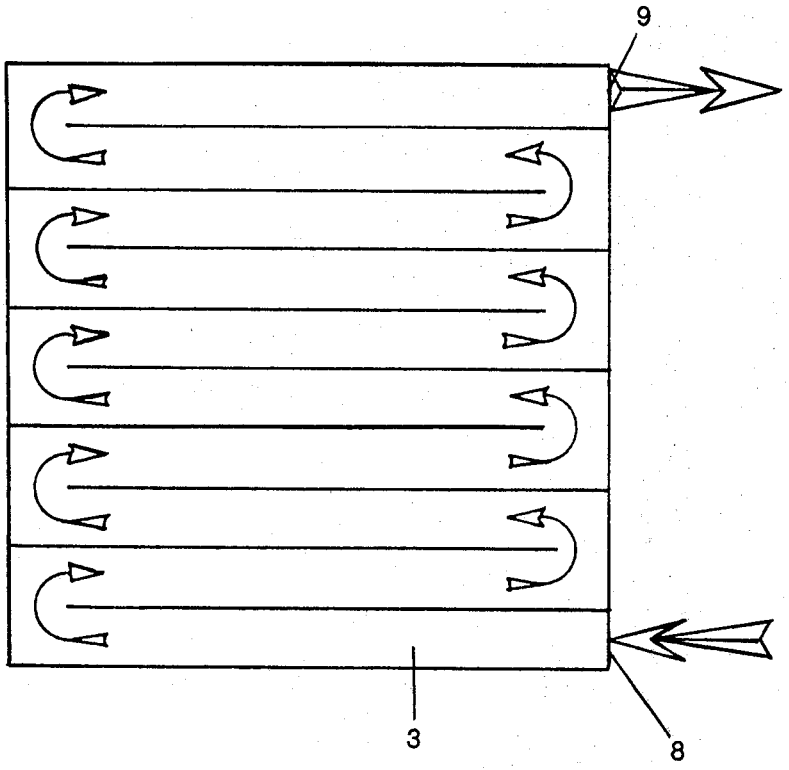

The invention will be better understood by means of the following description of one embodiment, with reference to the accompanying drawings, in which:

FIG. 1 is a view in side elevation of a wall for an electric furnace according to the invention, and FIG. 2 is a diagrammatic view in plan of said wall showing a possible circulation circuit of the cooling liquid.

In FIG. 1, the reference numeral 1 designates the internal furnace side of the wall, formed from a sheet of the order of 15 to 20 mm in thickness, of corrugated form. This thick wall 1 is welded to a second, relatively thin wall 2, of a thickness of the order of 5 mm, placed at the outside of the furnace. This wall 2, which may likewise have a corrugated shape, enables passages 3, in which the cooling liquid such as water is caused to circulate, to be defined with the wall 1.

The wall is held by two belts, an upper one 4 and a lower one 5, connected by uprights 6. Moreover, as shown in the drawing, bars 7 adapted to serve as holding members for a refractory mortar which will be applied all along this portion of the wall before the first use of the furnace, and which are adapted to serve as protection, are fixed to the furnace side of the wall 1.

The cooling fluid may have any path in the conduits 3. FIG. 2 gives a simple and advantageous example of this in which the water enters at the lower portion 8 of the wall to leave, after having circulated successively through all the conduits 3 then connected in series, at the upper portion 9 of said wall.

The invention finds its application in electric arc furnaces used in steel mills.

I claim:

1. A panel cooled by the circulation of liquid, adapted to constitute at least part of a wall of an electric furnace, comprising, at the interior of the furnace, a thick, corrugated wall, a thinner wall welded to said thick wall at the exterior of said furnace, said thick and thinner walls defining between them passages for the circulation of said cooling liquid.

2. A panel according to claim 1, wherein said thick wall has a thickness in the range of 15 to 20 mm.

3. A panel according to claim 2, wherein said thinner wall has a thickness of about 5 mm.

4. A panel according to claim 1, wherein said thinner wall also has a corrugated shape.

5. A panel according to claim 1, comprising bars adapted to provide support for a protective mortar at the furnace side of said thick wall.

* * * * *